US007828935B2

(12) United States Patent
Huang et al.

(10) Patent No.: US 7,828,935 B2
(45) **Date of Patent: *Nov. 9, 2010**

(54) PAPERS FOR LIQUID ELECTROPHOTOGRAPHIC PRINTING AND METHOD FOR MAKING SAME

(75) Inventors: Yan C Huang, Williamsburg, OH (US); David B Shelmidine, Ticonderoga, NY (US); Jeffrey R Becker, Bridport, VT (US); Ernie L Morgan, Hamilton, OH (US)

(73) Assignee: International Paper Company, Memphis, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/819,551

(22) Filed: Apr. 7, 2004

(65) Prior Publication Data

US 2004/0244928 A1 Dec. 9, 2004

Related U.S. Application Data

(63) Continuation-in-part of application No. 10/408,470, filed on Apr. 7, 2003, now abandoned.

(51) Int. Cl.
*D21H 21/16* (2006.01)
*D21H 17/28* (2006.01)
*D21H 17/37* (2006.01)

(52) U.S. Cl. ..... 162/168.1; 162/135; 162/158; 162/164.1; 162/175; 106/206.1; 106/215.2

(58) Field of Classification Search ..... 162/135, 162/158, 164.1, 168.1, 175; 106/206.1, 215.2
See application file for complete search history.

(56) References Cited

U.S. PATENT DOCUMENTS

| | | | | | |
|---|---|---|---|---|---|
| 3,644,258 | A | * | 2/1972 | Moore et al. | 524/162 |
| 3,872,039 | A | * | 3/1975 | Vaughn et al. | 524/35 |
| 3,991,256 | A | | 11/1976 | Cornier et al. | |
| 4,341,839 | A | | 7/1982 | Shaw et al. | |
| 4,375,533 | A | * | 3/1983 | Park et al. | 526/193 |
| 4,617,239 | A | | 10/1986 | Maruyama et al. | |
| 4,770,934 | A | | 9/1988 | Yamasaki et al. | |
| 4,908,240 | A | * | 3/1990 | Auhorn et al. | 427/391 |
| 4,911,451 | A | | 3/1990 | Sullivan et al. | |
| 4,970,119 | A | | 11/1990 | Koshizuka et al. | |
| 5,017,416 | A | | 5/1991 | Imperial et al. | |
| 5,045,587 | A | | 9/1991 | Tanaka | |
| 5,219,610 | A | | 6/1993 | Koshizuka et al. | |
| 5,286,521 | A | | 2/1994 | Matsuda et al. | |
| 5,302,249 | A | | 4/1994 | Malhotra et al. | |
| 5,326,499 | A | * | 7/1994 | Wegner et al. | 516/133 |
| 5,429,718 | A | * | 7/1995 | Morlino et al. | 162/72 |
| 5,437,925 | A | | 8/1995 | Macaulay et al. | |
| 5,508,108 | A | | 4/1996 | Tokiyoski et al. | |
| 5,591,489 | A | | 1/1997 | Dragner et al. | |
| 5,622,781 | A | | 4/1997 | Macaulay et al. | |
| 5,629,376 | A | * | 5/1997 | Sargent et al. | 524/745 |
| 5,674,664 | A | | 10/1997 | Tanikawa et al. | |
| 5,709,976 | A | | 1/1998 | Malhotra | |
| 5,741,889 | A | * | 4/1998 | Huang et al. | 530/210 |
| 6,048,439 | A | | 4/2000 | Huang et al. | |
| 6,146,648 | A | | 11/2000 | Bret et al. | |
| 6,165,320 | A | | 12/2000 | Bates et al. | |
| 6,171,444 | B1 | * | 1/2001 | Nigam | 162/158 |
| 6,197,383 | B1 | * | 3/2001 | Nigam | 427/391 |
| 6,241,787 | B1 | * | 6/2001 | Nigam | 8/543 |
| 6,355,448 | B1 | * | 3/2002 | Foltz et al. | 435/31 |
| 6,414,055 | B1 | * | 7/2002 | Lauzon | 524/47 |
| 6,426,381 | B1 | | 7/2002 | Konig et al. | |
| 6,482,886 | B1 | * | 11/2002 | Finlayson et al. | 524/562 |
| 6,565,708 | B2 | | 5/2003 | Ikeda et al. | |
| 6,793,860 | B2 | | 9/2004 | Xing et al. | |

(Continued)

FOREIGN PATENT DOCUMENTS

| | | |
|---|---|---|
| AU | 2003267281 | 4/2004 |

(Continued)

OTHER PUBLICATIONS

Carraher, Jr. C. E. Polymer Chemistry, 4th Ed Marcel Dekker, Inc. N. Y. 1996. p. xviii.*

(Continued)

*Primary Examiner*—Eric Hug
*Assistant Examiner*—Dennis Cordray
(74) *Attorney, Agent, or Firm*—Thomas W. Barnes, III; John K. Pike; Richard C. Stewart, II

(57) ABSTRACT

The specification discloses papers suitable for liquid electrophotographic printing ("LEP") and a method for making such papers. According to the method, a papermaking furnish containing cellulosic fibers is formed into a fibrous web on a papermaking machine and at least partially dried. The web is then treated with a sizing composition comprising starch, an acrylic acid polymer, an organic material having an HLB value of from about 2 to about 14 such as a polyglycerol ester, and water. The treated web is dried and calendered to a final desired caliper. Since the sizing composition is an aqueous mixture, it may be applied to the web on-line during production of the paper on the papermaking machine, thereby avoiding the expense and inconvenience of conventional off-line methods used to make existing LEP papers. The resulting paper exhibits at least 80% and preferably above 90% toner adhesion as measured by the tape pull tests used for the assessment of papers printed by LEP.

37 Claims, No Drawings

U.S. PATENT DOCUMENTS

| | | | | |
|---|---|---|---|---|
| 7,348,065 | B2 * | 3/2008 | Ono et al. | 428/514 |
| 2004/0055720 | A1 | 3/2004 | Torras, Sr. et al. | |
| 2004/0121080 | A1 | 6/2004 | Urscheler et al. | |
| 2004/0202820 | A1 | 10/2004 | Bharti | |
| 2005/0251976 | A1 | 11/2005 | Lipponen et al. | |

FOREIGN PATENT DOCUMENTS

| | | | |
|---|---|---|---|
| EP | 0322830 | | 12/1988 |
| EP | 0789281 | | 5/2002 |
| GB | 171382 | | 2/1923 |
| JP | 52-55707 | | 10/1993 |
| JP | 2000313168 | | 11/2000 |
| WO | WO 99/19773 | | 4/1999 |
| WO | WO 99/32718 | | 7/1999 |
| WO | WO01/53895 | | 7/2001 |
| WO | 02084029 | A2 | 10/2002 |
| WO | WO 2004/027145 | | 4/2004 |
| WO | WO 2004/092483 | | 10/2004 |

OTHER PUBLICATIONS

J. Peel, Paper Science & Paper Manufacture, 1999, p90.*
Smook, G.A., Handbook for Pulp and Paper Technologists, 2nd ed, Angus Wilde Publications, 1992, p. 285.*
J. Peel, Paper Science & Paper Manufacture 1999, pp. 18-19.*
Carraher, Jr. C.E. Polymer Chemistry, 4th Ed. Marcel Dekker, Inc. N.Y. 1996.p. xviii.
J. Peel, Paper Science & Paper Manufacture, 1999, p. 90.
Smook, G.A., Handbook for Pulp and Paper Technologiests, 2nd ed, Angus Wilde Publications, 1992, p. 285.

* cited by examiner

PAPERS FOR LIQUID ELECTROPHOTOGRAPHIC PRINTING AND METHOD FOR MAKING SAME

This application claims the benefit of priority to and is a Continuation-In-Part Application of U.S. patent application Ser. No. 10/408,470, entitled "PAPERS FOR LIQUID ELECTROPHOTOGRAPHIC PRINTING AND METHOD FOR MAKING THE SAME", which was filed on Apr. 7, 2003, abandoned, which is hereby incorporated, in its entirety, herein by reference.

FIELD OF THE INVENTION

The invention relates to the papermaking arts and, in particular, to a paper that exhibits improved performance in regard to liquid electrophotographic printing, and to a method for making the paper.

BACKGROUND OF THE INVENTION

Liquid electrophotographic printing ("LEP") is a printing technique that has experienced considerable growth in recent years. LEP stands in contrast to conventional dry electrophotography (or dry EP) printing techniques employed in "laser" printing and xerographic copying. In dry EP, dry toner particles are fixed to the paper being printed at relatively high temperatures at or above 130° C. In LEP, the toner particles are applied to the paper from dispersion in a liquid medium. With LEP printing, the toner particles are fixed to the paper at relatively lower temperatures in the order of from about 45° C. to 95° C.

Thus, for optimum printing, the paper used for the printing application must be receptive to receiving and fixing the LEP toner at these reduced temperatures. In the past, this has required that the paper be specially treated with a coating such as poly(ethyleneimine) in an off-line process after the manufacture of the paper has otherwise been completed. This additional off-line process adds considerable time and expense to the manufacture of papers suitable for LEP printing.

What is needed therefore is a new and improved process for producing a paper suitable for LEP, and which does not require an off-line coating step. There is also a need for a new and improved paper for LEP.

SUMMARY OF THE INVENTION

With regard to the foregoing and other needs, the present invention in one aspect provides a method for producing a paper suitable for LEP which comprises providing a papermaking furnish containing cellulosic fibers, forming a fibrous web from the papermaking furnish on a paper machine, treating the web with an aqueous composition comprising starch, an acrylic acid polymer or copolymer, an organic material having an HLB value of from about 2 to about 14 as for example a polyglycerol ester, and water, and drying the web. The web is preferably treated with the composition on the paper machine on-line in a size press, and the web is also calendered to a final desired caliper and smoothness on-line on the machine following drying. On-line treatment in the size press is enabled by reason of the fact that the ingredients of the composition are dispersible in water at a relatively low viscosity.

In another aspect, the invention provides a paper suitable for liquid electrophotographic printing comprising a web formed from cellulosic fibers having a basis weight of from about 75 to about 350 grams per square meter (gsm) and a caliper of from about 4 mils to about 20 mil. The web contains a surface size coating comprising starch, an acrylic acid polymer, and an organic material having an HLB value of from about 2 to about 14 as for example a polyglycerol ester.

In yet another aspect, the invention provides a novel composition for paper sizing. The sizing composition comprises starch, an acrylic acid polymer, an organic material having an HLB value of from about 2 to about 14 as for example a polyglycerol ester, and water and is preferably applied to the paper web on-line during formation of the paper on the paper machine in the size press.

Regarding the starch in the sizing composition, in certain embodiments of the invention it is preferred that the starch comprises an anionic starch in an aqueous mixture. Preferred starch sources for use in the invention include cornstarch and potato starch. The starch preferably comprises from about 40 to about 80 percent of the total solids of the sizing mixture and more preferably comprises from about 40 to about 59 percent of the total solids of the mixture.

The acrylic acid polymer component of the sizing composition is preferably selected from the group consisting of poly(ethylene acrylic acid), ethylene acrylic acid co-polymer, poly (ethylene-acrylic acid co-polymer), poly(ethylene-co-methacrylic acid), poly(ethylene-acrylic acid co-polymer) and mixtures thereof. Most preferably, the acrylic acid polymer comprises ethylene acrylic acid copolymer. In certain embodiments of the invention, it is preferred the acrylic acid polymer comprises from about 20 to about 60 percent of the total solids of the sizing composition. More preferably, the acrylic acid polymer comprises from about 40 to about 60 percent of the total solids of the sizing composition.

The sizing composition includes an organic material having an HLB value of from about 2 to about 12. Suitable organic materials are polyglycerol esters having HLB values within the desired range such as decaglyceryl hexaoleate, decaglyceryl decaoleate, glyceryl tricaprylate, glyceryl tricaprate and mixtures thereof. More preferably, the polyglycerol ester comprises decaglyceryl hexaoleate.

The amount of organic material included in the sizing composition may vary widely. The organic material preferably comprises from about 0.5 to about 7 percent of the total solids of the sizing composition and more preferably comprises from about 0.5 to about 1.5 percent of the total solids of the sizing composition.

In certain embodiments, it is also preferred that the sizing composition, as applied to the web, comprises from about 6 to about 10 percent solids. Again, the sizing composition is preferably applied as an aqueous mixture on-line at the size press. It is also preferred the pickup of the sizing composition at the size press be maintained at from about 30 to about 150 lbs per ton of paper.

As for the paper itself, it is preferred that the web is calendered to a final caliper of from about 4 to about 20 mils. It is also preferred that the web have a final basis weight of from about 75 to about 350 gsm. However, the invention may also be used to provide paperboard products having relatively higher basis weights and thicknesses, in which case the final caliper may be up to about 80 mils and the basis weight may range from about 250 to about 600 gsm. Preferred fibrous components of the papermaking furnish include from about 80 to about 95 hardwood fibers and from about 5 to about 20 softwood fibers. These fibers may be bleached or unbleached, refined or unrefined, and may be treated in various ways known to those of ordinary skill according to what is required for the intended product grade and properties. Those of ordinary skill in the papermaking arts will also appreciate that other components of the furnish may be used in order to provide papers and paperboards having desired final properties of stiffness, tear and burst strength, and the like.

Papers made according to the invention have been observed to provide improved performance when printed upon using liquid electrophotographic printing techniques. Papers according to the invention have been found to exhibit at least about 80% and preferably above about 90% toner adhesion according to the tape pull tests used for the assessment of paper printed by LEP. Moreover, the papers may be manufactured faster and more efficiently than previous papers intended for liquid electrophotographic printing because there is no need to apply any special coatings such as poly(ethyleneimine) to the paper in an "off-line" process in order to make render it usable for liquid electrophotographic printing.

DETAILED DESCRIPTION OF THE INVENTION

The invention provides a paper material suitable for liquid electrophotographic printing comprising a web formed from cellulosic fibers and having a basis weight of from about 75 to about 350 gsm, a caliper of from about 4 mils to about 20, and a surface coating comprising starch, an acrylic acid polymer, and an organic material having an HLB value of from about 2 to about 14 such as a polyglycerol ester. Papers coated with this sizing composition have been found to have excellent printability via liquid electrophotographic techniques without the need for additional offline coating applications.

As used herein, "paper" refers to and includes both paper and paperboard unless otherwise noted.

The paper is provided as a web containing cellulosic pulp fibers such as fiber derived from hardwood trees, softwood trees, or a combination of hardwood and softwood trees prepared for use in a papermaking furnish by any known suitable digestion, refining, and bleaching operations. The cellulosic fibers may include up to about 50 percent by weight dry basis softwood fibers. In a preferred embodiment, the cellulosic fibers in the paper include up to about 30 percent by weight dry basis softwood fibers and at least about 70 percent by weight dry basis hardwood fibers. More preferably, the cellulosic fibers in the paper include from about 5 percent to about 20 percent by weight dry basis softwood fibers and from about 80 percent to about 95 percent by weight dry basis hardwood fibers. Most preferably, the cellulosic fibers in the paper include from about 12 percent to about 17 percent by weight dry basis softwood fibers and from about 83 percent to about 88 percent by weight dry basis hardwood fibers.

In certain embodiments of the invention, at least a portion of the fibers may also be provided from renewable non-woody agricultural fiber sources such as wheat straw, rice straw, soybean stalks, fescue straw, blue grass straw, bagasse, hemp, and kenaf.

The paper may also include other conventional additives such as, for example, starch, mineral fillers, sizing agents, retention aids, and strengthening polymers.

Papers formed according to the present invention preferably have a final caliper, after calendering of the paper, and any nipping or pressing such as may be associated with subsequent coating, of from about 4 to about 20 mils. Papers of the invention also typically exhibit basis weights of up to about 300 grams per square meter (gsm). Preferably the basis weight ranges from about 75 to about 350 gsm, more preferably from about 100 to about 250 gsm, and most preferably from about 105 to about 215 gsm.

Papers manufactured according to the present invention exhibit good smoothness properties as well. When measured according to the Sheffield smoothness test using a Hagerty testing instrument, the papers may exhibit smoothness values as low as 10 Sheffield units. Preferably, the papers have Sheffield smoothness values from about 15 to about 180 Sheffield units, More preferably the papers have Sheffield smoothness value from about 25 to 160 Sheffield units and most preferably from about 60 to about 90 Sheffield units.

In another embodiment, the present invention is used to provide a paperboard. In this embodiment of the invention, the final caliper preferably range up to about 80 mils and the basis weight preferably ranges from about 250 to about 600 gsm The method of making the paper materials of the present invention includes providing an initial paper furnish. The cellulosic fibrous component of the furnish is suitably of the chemically pulped variety, such as a bleached kraft pulp, although the invention is not believed to be limited to kraft pulps, and may also be practiced using other chemical pulps such as sulfite pulps, mechanical pulps such as ground wood pulps, and other pulp varieties and mixtures thereof such as chemical-mechanical and thermo-mechanical pulps.

While not believed to be essential to the invention, the pulp is preferably bleached to remove lignins and to achieve a desired pulp brightness according to one or more bleaching treatments known in the art including, for example, elemental chlorine-based bleaching sequences, chlorine dioxide-based bleaching sequences, chlorine-free bleaching sequences, elemental chlorine-free bleaching sequences, and combinations or variations of stages of any of the foregoing and other bleaching sequences and stages.

After bleaching is completed and the pulp is washed and screened, it is generally subjected to one or more refining steps. Thereafter, the refined pulp is passed to a blend chest where it is mixed with various additives and fillers typically incorporated into a papermaking furnish as well as other pulps such as unbleached pulps and/or recycled or post-consumer pulps. The additives may include so-called Ainternal sizing@ agents used primarily to increase the contact angle of polar liquids contacting the surface of the paper such as alkenyl succinic anhydride (ASA), alkyl ketene dimer (AKD), ketene multimers, and rosin sizes. Retention aids may also be added at this stage, including cationic retention aid and anionic retention aids. Suitable fillers include calcium carbonate fillers such as ground calcium carbonate (GCC) and precipitated calcium carbonate (PCC) and may be present in an amount sufficient to provide up to about 30 percent, by weight, of the overall dry weight of the finished paper. Preferably, sufficient fillers are added to provide from about 8 to about 30 weight percent of the overall dry weight of the finished paper, more preferably from about 12 to about 26 weight percent, and most preferably from about 16 to about 22 weight percent.

Once prepared, the furnish is formed into a single or multiply web on a papermaking machine such as a Fourdrinier machine or any other suitable papermaking machine known in the art, as well as those which may become known in the future. The basic methodologies involved in making paper on various papermaking machine configurations are well known to those of ordinary skill in the art and accordingly will not be described in detail herein. In general, a so-called Aslice@ of furnish consisting of a relatively low consistency aqueous slurry of the pulp fibers along with the various additives and fillers dispersed therein is ejected from a headbox onto a porous endless moving forming sheet or wire where the liquid is gradually drained through small openings in the wire until a mat of pulp fibers and the other materials is formed on the wire. The still-wet mat or web is transferred from the wire to a wet press where more fiber-to-fiber consolidation occurs and the moisture is further decreased. The web is then passed to an initial dryer section to remove most of the retained moisture and further consolidate the fibers in the web.

After initial drying, the web may be further treated using a size press wherein a sizing composition is applied to the web and incorporated therein by the action of the press. Importantly, the sizing composition according to the invention comprises starch, an acrylic acid polymer, a polyglycerol ester, and water. The sizing composition may also include pigments and other additives.

As is generally the case in the surface sizing of paper, the sizing composition employed in the present invention is an aqueous-based mixture. It has been found that the solids in the sizing composition may comprise up to about 20 percent of the mixture. Preferably, the solids content of the sizing mixture ranges from about 6 to about 10 percent by weight with the balance of the mixture comprising water.

The starch solids in the sizing mixture may comprise up to about 89 percent by weight of the total solids of the mixture. Preferably, the starch solids comprises from about 40 to about 80 percent of the total solids of the mixture and more preferably comprise from about 40 to about 59 percent of the total solids of the mixture.

A wide variety of known starches may be employed in the practice of the present invention. It is believed that anionic starches and amphoteric starches may both be utilized in sizing mixture, however, it is preferred that the starch be an anionic starch. Preferred starch sources for use in the invention include cornstarch and potato starch, although starches derived from wheat, rice, tapioca, and sago may also be utilized. A suitable starch is Penford Gum 290 available from Penford Products Co. of Cedar Rapids, Iowa. The starch may be an unmodified pearl starch or may be chemically modified by known techniques such as oxidation, hydroxyethylation, hydroxyalkyl etherisation, carboxylation, or phosphate esterification.

The sizing composition also includes an acrylic acid polymer. As used herein, the term "acrylic acid polymer" refers to and includes any polymer or copolymer including either acrylic acid or methacrylic acid monomer units.

Suitable acrylic acid polymers for use in the sizing composition include acrylic acid polymers selected from the group consisting of poly(ethylene acrylic acid), ethylene acrylic acid co-polymer, poly(ethylene-acrylic acid co-polymer), poly(ethylene-co-methacrylic acid), poly (ethylene-acrylic acid co-polymer) and mixtures thereof. Of the foregoing, the acrylic acid polymer most preferably comprises an ethylene acrylic acid co-polymer. The weight percentage of acrylic or methacrylic acid monomer units in the acrylic acid polymer is preferably at least about 12 percent and may comprise up to about 50 percent. The acrylic acid polymer preferably has a crystalline melting point of from about 60° C. to about 90° C.

Commercially available acrylic acid polymers that may be employed in the sizing composition include the poly(ethylene-co-methacrylic acid) available from DuPont under the trade name SURLYN and the poly(ethylene-acrylic acid co-polymer) available from Dow Chemical Co. under the trade name PRIMACOR. Suitable acrylic acid polymers pre-dispersed in aqueous solution are also available from Michelman, Inc. of Cincinnati, Ohio under the trade name MICHEM PRIME and from Mica Corporation of Stratford, Conn. under the trade name MICA G-927.

The acrylic acid polymer may preferably comprise from about 20 to about 60 percent of the total solids of the sizing composition. More preferably, the acrylic acid polymer comprises from about 40 to about 60 percent of the total solids of the sizing composition.

The acrylic acid polymer is believed to play an important role in the improved adherence of LEP toner to papers made according to the invention, and in the ability to apply the surface sizing from an aqueous mixture on-line during the papermaking process proper in contrast to existing/prior art off-line processes heretofore used to make papers suitable for LEP.

The sizing composition includes an organic material having an HLB value of from about 2 to about 12. HLB values and procedures for determining them are known in the literature. See for example "PAINT FLOW AND PIGMENT DISPERSION A Rheological Approach to Coating and Ink Technology", 2" Edition, Temple C. Patton, John Wiley & Sons at pages 285 to 288 and "1995 McCutcheon's Vol 1: Emulsifiers & Detergents North American Edition, The Manufacturing Confectioner Publishing Co." The HLB of the organic material is preferably from about 2.5 to about 8.0 and more preferably from about 3 to about 6.

Illustrative of useful organic materials are fatty acid esters of poly hydric compounds having an HLB value within the required range as for example fatty acid esters of glycerin/glycerol and glycols such as polyethylene glycol and poly propylene glycol. Preferred organic materials are fatty acid esters of glycerin/glycerol and glycols and more preferred organic materials are fatty acid esters of glycerin/glycerol or polyglycerol esters. Preferred polyglycerol esters are decaglyceryl hexaoleate, decaglyceryl decaoleate, glyceryl tricaprylate, glyceryl tricaprate and mixtures thereof and the most preferred polyglycerol ester is decaglyceryl hexaoleate.

The amount of organic material included in the sizing composition may vary widely provided that it provides the desired toner adhesion. The organic material having a HLB value within the desired range is believed to enable the attainment of viscosities in the sizing composition appropriate for application of the mixture to the web at the size press under the demanding conditions of modern high-speed paper machines. The mixture viscosities may range from about 10 to about 300 centipoises (cP) and more preferably from about 15 to about 120 cP. The organic material may comprise up to about 8 percent of the total solids of the sizing composition. Preferably, the organic material comprises from about 0.5 to about 7 percent of the total solids of the sizing composition. More preferably, the organic material comprises from about 0.5 to about 1.5 percent of the total solids of the sizing composition.

Suitable organic materials may be prepared by known techniques or obtained from commercial sources. For example, suitable polyglycerol esters are available from Stepan Company of Maywood, N.J. under the trade names DREWPOL and NEOBEE.

As noted, the sizing composition is preferably applied size press, i.e., "on-line" during the normal papermaking process. The sizing composition may be applied to the paper in a conventional manner well known to those of skill in the art. The sizing composition may be applied to the paper prior to pressing by puddle application, by rod-metered application, by blade-metered application, or by any other known or hereafter known size press technique.

The pickup rate of the sizing composition (dry basis) at the size press may be up to about 150 lbs per ton of paper. Preferably, the pickup rate ranges from about 30 to about 150 lbs per ton of paper, more preferably from about 50 to about 140 lbs per ton, and most preferably from about 70 to about 130 lbs per ton of paper.

After treatment in the size press and subsequent drying, the paper is calendered to achieve the desired final caliper as discussed above to improve the smoothness and other properties of the web. The calendering may be accomplished by steel-steel calendaring at nip pressures sufficient to provide a desired caliper. It will be appreciated that the ultimate caliper of the paper ply will be largely determined by the selection of the nip pressure. Preferably the final caliper is from about 4 to about 20 mils.

As noted, the papers so produced may be advantageously used for liquid electrophotographic printing. No further off-line treatment of the paper is needed to provide suitable liquid toner adhesion to the paper. Thus, the paper may be produced more quickly and less expensively than prior papers intended for liquid electrophotographic printing. Moreover, papers produced according to the invention have also been observed to be suitable for use in various other printing applications including traditional offset printing applications. Thus, the papers produced are truly multipurpose in nature.

The following nonlimiting examples illustrate various additional aspects of the invention. Unless otherwise indicated, temperatures are in degrees Celsius, percentages are by weight and the percent of any pulp additive or moisture is based on the oven-dry weight of the pulp.

Example 1

A series of dual-purpose copying and offset printing paper handsheets were prepared, printed by liquid electrophotographic printing, and tested for toner adhesion. The handsheets were prepared from a pulp furnish comprising about 88 weight percent hardwood fibers and about 12 percent softwood fibers. The furnish also included about 20 wt. percent of calcium carbonate as filler and conventional additives.

After being formed and allowed to substantially dry, each hand sheet was then hand feed through a laboratory size press where it was sized with a sizing composition (except for an unsized control sample). In each case, the sizing composition was applied at about 10% by weight solids at a pick-up rate of about 75 #/ton (dry basis). However, the solids composition of the sizing compositions varied in terms of the relative amounts of starch (Penford Gum 290), acrylic acid polymer (MICHEM PRIME 4990R), and the presence or absence of a polyglycerol ester (decaglyceryl hexaoleate as DREWPOL 10-6-0K) as described in Table I. After sizing, the hand sheets were calendered to provide finished hand sheets having a caliper of about 3.7 mils and a basis weight of about 70 #/330 $ft^2$ (104 gms).

The finished hand sheets were then printed by the liquid electrophotographic technique on a Hewlett-Packard Indigo Digital Press 3000 printer. Finally, after printing, the adhesion of the toner to the printed-paper was tested by tape pull tests at intervals of 15 minutes after the printing and 2 hours after the printing. No significant difference was noted in the results after 2 hours.

In the tape pull tests, a piece of 3M SCOTCH 230 drafting tape was applied to the paper and adhered thereto by rolling a 2 kg rubber coated roller over the tape a total of 5 times to press the tape to the paper surface. The tape pulls were removed using an automated tape pull device available from Chem Instruments, Inc.

The amount toner removal by the tape pulls was observed and recorded and the results are summarized below in Table I.

TABLE I

| Sample No. | Starch (Wt. %) | Acrylic Acid Polymer (Wt. %) | Polyglycerol Ester (wt % of total solids) | Toner Adhesion/ Removal (15 mins) |
|---|---|---|---|---|
| Control | 0 | 0 | No | V. high removal |
| 1 | 100 | 0 | No | V. high removal |
| 2 | 80 | 20 | No | High removal |
| 3 | 60 | 40 | No | High removal |
| 4 | 40 | 60 | No | Slightly lower removal than 1-3 |
| 5 | 40 | 60 | No | Slightly lower removal than 1-3 |
| 6 | 40 | 60 | No | V. high removal |
| 7 | 40 | 60 | 0.5 | Lower removal |
| 8 | 40 | 60 | 0.5 | Lower removal |

As may be seen from the results, both the unsized control sample and Sample No. 1, which was sized only with starch, exhibited very high levels of toner removal implying very low levels of toner adhesion. Sample Nos. 2-6 demonstrate the use of an acrylic acid polymer in the sizing composition has some effect in reducing the toner removal. Thus, it improves toner adhesion to some degree alone. Finally, Sample Nos. 7 and 8 demonstrate that when the sizing composition includes a small amount of polyglycerol ester in addition to the starch and the acrylic acid polymer, a significant reduction in the toner removal is observed demonstrating the toner adhesion to the paper has been significantly increased.

Example II

In a second series of tests, a series of sizing compositions were prepared and their respective viscosities measured. In these sizing compositions, the starch is PENFORD GUM 290, the acrylic acid polymer is MICHEM PRIME 4990R and the polyglycerol ester is DREWPOL 10-6-OK. For each sizing composition, the Brookfield viscosity was measured using a No. 2 spindle operating at 50 rpms and at a fluid temperature of 65° C. The results are reported in Table II.

TABLE II

| Sample No. | Starch/Acrylic Acid Polymer Ratio (wt./wt.) | Polyglycerol Ester (wt. % based on dry starch) | Total Solids (wt. %) | Brookfield Viscosity (cps) |
|---|---|---|---|---|
| 1 | 100/0 | 0 | 10 | 67.9 |
| 2 | /100 | 0 | 10 | 14.2 |
| 3 | 50/50 | 0 | 10 | 576 |
| 4 | 50/50 | 0 | 7 | 472 |
| 5 | 100/0 | 1 | 10 | 68.8 |
| 6 | 50/50 | 1 | 10 | 612 |
| 7 | 50/50 | 1 | 7 | 72.0 |

The viscosity data recorded demonstrates that while the compositions including either starch or acrylic acid polymer alone have relatively low viscosities, attempts to combine the two components in a single sizing composition result in extremely high viscosity mixtures. Compositions with such high viscosities are impractical for online application to the paper at the size press of a modern, high-speed papermaking machine. However, addition of a small amount of polyglycerol ester (about 1% of the total weight of the starch solids) leads to an extraordinary decrease in viscosity, thus allowing the composition to be effectively applied online at the size press in a high-speed papermaking machine.

Example III

A series of papers were produced on a papermaking machine in accordance with the present invention employing a papermaking furnish and size press composition according to Example I, except that the solids content of the size press was set at 8.5% with a pick-up of 83 lb./ton (dry basis) at the size press. Also, the starch and acrylic acid polymer components each made up 49.5 wt. % of the solids and the polyglycerol component made up 1 wt. % of the non-aqueous components. Two sets of papers were made, one at a basis weight of 104 gins and the other at a basis weight of 118 gms. After sizing and calendering the finished papers were printed, on both sides, with a Hewlett-Packard Indigo Digital Press 3000 printer. Finally, tape pull tests were conducted at 15 minutes after printing with SCOTCH 230 drafting tape according to the procedure described in Example I. However, the amount of toner adhesion (comparing toner on the paper after a tape pull to the toner on the paper before the tape pull) was measured using an X-RITE Model 404 densitometer to obtain quantitative measurements. The results of the tests are reported in Table III.

TABLE III

| Sample | Basis Weight (gms) | Paper Side | % Toner Retention |
|---|---|---|---|
| 1 | 104 | Front | 99 |
| 1 | 104 | Back | 98 |
| 2 | 118 | Front | 97 |
| 2 | 118 | Back | 98 |

Using this testing procedure, 80% toner retention is conventionally considered to be commercially acceptable. Thus, the test results, in which at least 97% toner retention was achieved in each instance, are quite remarkable and demonstrate that the sizing composition provides for truly exceptional toner adhesion in excess of 90%. Moreover, the toner adhesion is believed to be independent of the basis weight of the paper being printed upon.

Having now described various aspects of the invention and preferred embodiments thereof, it will be recognized by those of ordinary skill that numerous modifications, variations and substitutions may exist within the spirit and scope of the appended claims.

What is claimed is:

1. A paper suitable for liquid electrophotographic printing, comprising:

a web of cellulosic fibers; and a composition comprising from about 40 to about 80 wt % of starch based upon the total weight of solids of the composition, about 20 to about 60 wt % of no more than one sizing agent based upon the total solids of the composition, said sizing agent consisting of an acrylic acid polymer, and from about 0.5 to about 7 wt % of an organic material comprising at least one polyglycerol ester and having an HLB value of from 2 to 14 based upon the total weight of solids of the composition, wherein from 30 to 150 dry lbs of the composition are located in the web per dry ton of web; or from 30 to 150 dry lbs of the composition are located on the web and in the web per dry ton of web.

2. The paper according to claim 1, wherein the starch comprises corn starch.

3. The paper according to claim 1, wherein the starch comprises anionic starch.

4. The paper according to claim 1, wherein the composition comprises from about 0.5 to about 1.5 wt % of the organic material having an HLB value of from 2 to 14 based upon the total weight of solids of the composition.

5. The paper according to claim 1, wherein the acrylic acid polymer comprises ethylene acrylic acid co-polymer.

6. The paper according to claim 1, wherein the polyglycerol ester is at least one member selected from the group consisting of decaglyceryl hexaoleate, decaglyceryl decaoleate, glyceryl tricaprylate, and glyceryl tricaprate, and a mixture thereof.

7. The paper according to claim 1, wherein the polyglycerol ester is decaglyceryl hexaoleate.

8. The paper according to claim 1, wherein the web has a basis weight of from about 75 to about 300 gsm.

9. The paper according to claim 1, wherein the web has a caliper of from about 5 to about 20 mils.

10. A method of making a paper suitable for liquid electrophotographic printing, comprising providing a papermaking furnish containing cellulosic fibers, forming a fibrous web from the papermaking furnish, at least partially drying the web;

treating the web with from about 30 to about 150 lbs/ton of web of a composition comprising from about 40 to about 80 wt % of starch based upon the total weight of solids of the composition; from about 20 to about 60 wt % of no more than one sizing agent based upon the total weight of solids of the composition, said sizing agent consisting of an acrylic acid polymer; from about 0.5 to about 7 wt %, of an organic material comprising at least one polyglycerol ester and having an HLB value of from 2 to 14 based upon the total weight of solids of the composition; and water.

11. The method according to claim 10, wherein the starch comprises corn starch.

12. The method according to claim 10, wherein the starch comprises anionic starch.

13. The method according to claim 10, wherein the composition comprises from about 0.5 to about 1.5 wt % of the organic material having an HLB value of from 2 to 14 based upon the total weight of solids of the composition.

14. The method according to claim 10, wherein the acrylic acid polymer comprises ethylene acrylic acid co-polymer.

15. The method according to claim 10, wherein the polyglycerol ester is at least one member selected from the group consisting of decaglyceryl hexaoleate, decaglyceryl decaoleate, glyceryl tricaprylate, and glyceryl tricaprate, and a mixture thereof.

16. The method according to claim 10, wherein the polyglycerol ester is decaglyceryl hexaoleate.

17. The method according to claim 10, wherein the composition, as applied to the web, comprises from about 6 to about 10 wt % solids.

18. The method according to claim 10, wherein the composition, as applied to the web, has a Brookfield viscosity of from about 10 to about 300 cp using a No. 2 spindle operating at 50 rpms and a fluid temperature of 65° C.

19. The method according to claim 10, further comprising calendering the web.

20. The method according to claim 10, wherein the web is treated with the composition at a size press.

21. The method according to claim 10, wherein at least one surface of the web is treated with the composition.

22. A paper suitable for liquid electrophotographic printing, comprising:

a web of cellulosic fibers; and a composition comprising from about 40 to about 80 wt % of starch based upon the total weight of solids of the composition, no more than one sizing agent, said sizing agent consisting of an acrylic acid polymer, and from about 0.5 to about 7 wt % of an organic material based upon the total weight of solids of the composition wherein the organic material has an HLB value of from 2 to 14 and comprises decaglyceryl hexaoleate, wherein from 30 to 150 dry lbs of the composition are located in the web per dry ton of web; or from 30 to 150 dry lbs of the composition are located on the web and in the web per dry ton of web.

23. The paper according to claim 22, wherein the starch comprises corn starch.

24. The paper according to claim 22, wherein the starch comprises anionic starch.

25. The paper according to claim 22, wherein the composition comprises from about 0.5 to about 1.5 wt % of the organic material based upon the total weight of solids of the composition, wherein the organic material has an HLB value of from 2 to 14 and comprises decaglyceryl hexaoleate.

26. The paper according to claim 22, wherein the acrylic acid polymer comprises ethylene acrylic acid co-polymer.

27. The paper according to claim 22, wherein the web has a basis weight of from about 75 to about 300 gsm.

28. The paper according to claim 22, wherein the web has a caliper of from about 5 to about 20 mils.

29. A method of making the paper according to claim 22, comprising providing a papermaking furnish containing cellulosic fibers, forming a fibrous web from the papermaking furnish, at least partially drying the web;

treating the web with from about 30 to about 150 lbs/ton of web of a composition comprising from about 40 to about 80 wt % of starch based upon the total weight of solids of the composition; no more than one sizing agent, said sizing agent consisting of an acrylic acid polymer; from about 0.5 to about 7 wt %, of a organic material based upon the total weight of solids of the composition wherein the organic material has an HLB value of from 2 to 14 and comprises decaglyceryl hexaoleate; and water.

30. The method according to claim 29, wherein the starch comprises corn starch.

31. The method according to claim 29, wherein the starch comprises anionic starch.

32. The method according to claim 29, wherein the composition comprises from about 0.5 to about 1.5 wt % of the organic material having an HLB value of from 2 to 14 based upon the total weight of solids of the composition, wherein the organic material has an HLB value of from 2 to 14 and comprises decaglyceryl hexaoleate.

33. The method according to claim 29, wherein the acrylic acid polymer comprises ethylene acrylic acid co-polymer.

34. The method according to claim 29, wherein the composition, as applied to the web, comprises from about 6 to about 10 wt % solids.

35. The method according to claim 29, wherein the composition, as applied to the web, has a Brookfield viscosity of from about 10 to about 300 cp using a No. 2 spindle operating at 50 rpms and a fluid temperature of 65° C.

36. The method according to claim 29, wherein the web is treated with the composition at a size press.

37. The method according to claim 29, wherein at least one surface of the web is treated with the composition.

* * * * *